US005143484A

United States Patent [19]

Deul

[11] Patent Number: 5,143,484

[45] Date of Patent: Sep. 1, 1992

[54] MINE CRIBBING DEVICE AND METHOD

[76] Inventor: Maurice Deul, 817 Hillaire Dr., Pittsburgh, Pa. 15243

[21] Appl. No.: 661,495

[22] Filed: Feb. 26, 1991

[51] Int. Cl.[5] ..... E21D 11/00

[52] U.S. Cl. ..... 405/288; 405/258; 405/303

[58] Field of Search ..... 405/288, 289, 21, 16, 405/233, 246, 150, 151; 52/585

[56] References Cited

U.S. PATENT DOCUMENTS

| | | | |
|---|---|---|---|
| 3,396,545 | 8/1968 | Lamberton | 405/233 |
| 3,492,823 | 2/1970 | Lamberton | 405/233 |
| 4,465,405 | 8/1984 | Durrfeld | 405/289 |
| 4,497,597 | 2/1985 | Chlumecky | 405/288 |
| 4,997,309 | 3/1991 | Kiselewski | 405/16 |
| 5,024,560 | 6/1991 | Reilly | 405/16 X |

FOREIGN PATENT DOCUMENTS

| | | | |
|---|---|---|---|
| 2324214 | 11/1974 | Fed. Rep. of Germany | 405/33 |

OTHER PUBLICATIONS

Bureau of Mines Report of Investigations 8804, 1983 (Smelser and Henton).

Bureau of Mines Report of Investigations 9161, 1988 (Barczak and Schwemmer).

Bureau of Mines Report of Investigations 9168, 1988 (Barczak and Tasillo).

Bureau of Mines Information Circular 9217, 1989 (Barczak, Schwemmer and Tasillo).

Commercial Shearing, Inc. Catalog M-12 3MSR5/87.

*Primary Examiner*—Dennis L. Taylor

*Attorney, Agent, or Firm*—Morgan & Finnegan

[57] ABSTRACT

Novel crib members useful in building cribbing to support roofs in underground mines or in tunnel construction and all other underground excavations where roof and ground control is of concern. These crib members are made by filling an envelope of a reinforced elastomeric material with concrete. In a preferred form used motor vehicle tires are filled with concrete.

7 Claims, 3 Drawing Sheets

MINE CRIBBING DEVICE AND METHOD

BACKGROUND OF THE INVENTION

1. Field Of The Invention

This invention relates to novel crib members for use in building cribbing to support roofs in underground mines opened to remove mineral deposits such as coal, tabular mineral deposits, and metal ore. The crib members of this invention may also be used advantageously in tunnel construction and in all other subterranean excavations where roof and ground control is a matter of concern. In addition, the crib members of the invention may be advantageously used to stabilize soil embankments and to construct jetties and offshore artificial reefs.

2. Description Of The Prior Art

Wood has long been the material of choice for crib construction due to its availability and its moderate strength in compression and because, in small dimensions, it is easy to handle. Wood, however, has the disadvantages of relatively low compressive strength and Young's modulus, non-uniformity from piece to piece, flammability, rot and deterioration.

Recently, with the need for more reliable roof support, crib members constructed of ordinary concrete, steel wire reinforced concrete, and steel fiber reinforced concrete are being used in underground mining. Such crib members may have dimensions like ordinary wood cribbing, with a rectangular cross section and lengths up to 48 inches. Alternatively, the concrete members may be constructed as flat disks, typically three inches thick and 22 inches in diameter or as flat washers, typically 22 inches in diameter with a 12 inch diameter perforation, or as concrete cylinders. Such concrete disks, washers or cylinders are stacked vertically in axial alignment to the desired height.

Concrete cribbing has the advantage of greater compressive strength, but tends to fail catastrophically, rather than deforming like wood. The concrete members also tend to require wood spacers to retard horizontal movement, which increases material and installation costs. These drawbacks thus affect both safety and economics.

An example of attempts to improve concrete member cribbing is described in Chlumecky U.S. Pat. No. 4,497,597. This patent describes the use of axially stacked concrete washer members, reinforced by an annular metal band firmly attached to the periphery of the washer. Deformation is into the central hole, since the metal band does not yield radially. A commercial embodiment said to be manufactured under this patent is described in Commercial Shearing, Inc., Catalog M-12 3 MSR 5/87, which shows washer and disc configurations used with thick fiber shims to distribute the load throughout the crib.

Bureau of Mines Report of Investigations 8804, 1983, Smelser & Hanton describes different steel fiber reinforced concrete crib designs for mine roof support using rectangular shapes in conjunction with wood wedging and blocking.

Bureau of Mines Report of Investigations 9161, 1988, Barczak & Schwernmer describes the effect of rate of loading on deformation of wood cribbing for mine roof support.

Bureau of Mines Report of Investigations 9168, 1988, Barczak & Tasillo describes how height, configuration and horizontal displacement of wood cribbing affects its strength and stability.

Bureau of Mines Information Circular 9217, 1989, Barczak, Schwernmer & Tasillo describes factors in designing wood and concrete cribs as gate road supports in longwall mining. Rectangular and flat washer shaped concrete cribbing is disclosed.

SUMMARY OF THE INVENTION

The present invention provides a crib member comprising an envelope means of a reinforced elastomeric material, preferably a toroid, filled with concrete. An elastomeric material as used herein refers to all substances having the properties of natural, reclaimed, vulcanized or synthetic rubber. Many kinds of such enveloping forms that are available can be utilized The shape can be chosen based upon the particular utility or need. A preferred form is a toroidal envelope, with the most preferred form being substantially open at the inner periphery. Amongst such materials which can be used are radial and bias-ply tires which are reinforced with cotton, steel, rayon, nylon, polyester, fiberglass or other synthetic fibers. These tires may be new or used, preferably used.

The cribbing of this invention provides a unique combination of advantages not available in any other form of cribbing now in use. Specifically, cribbing of the invention combines the advantages of prior art cribbing, while avoiding the disadvantages. For example, the present cribbing has the strength and load bearing capacity of concrete without the risk of catastrophic failure, as well as the long term bearing capacity of wood cribbing. The design of a motor vehicle tire (the preferred envelope means form), fiber reinforced and with steel wire in the bead, provides a high degree of elastic confinement for the core so that a high compressive strength for the module can be attained.

In mines where yieldable support must be maintained under high load and very high stresses and cribbing may fail catastrophically, cribbing made from new or used steel belted radial tires containing steel wire bead prevents such failure, even if the concrete core is crushed.

Where high compressive strength is required so that steel fiber reinforced concrete must be used, the crib member does not require special care in handling because the rubber envelope provides a protective cover. The reinforced rubber - envelope around the concrete core in the instant crib member, 5 also provides a resilient layer that precludes the need for load transfer disks as recommended for concrete disk and concrete washer cribbing.

The time and labor necessary to install the crib elements manufactured from concrete filled motor vehicle tires is thus reduced significantly over that needed for concrete cribs. The resilient rubber envelope also eliminates the need for the recommended inclusion of 1 inch of wood for each foot of crib height.

The availability of a wide range of sizes of motor vehicle rubber tires makes it possible for many different sizes of crib elements to be made to meet the requirements for constructing cribs for all sizes of mine entries from the lowest to fifteen feet high or more. Concrete filled motor vehicle tire elements such as those made from used tires from rock hauling trucks and excavators range in size from four feet to more than 10 feet in diameter and up to 41 inches in thickness. Such crib elements in multiples of 5 could thus provide support in entries up to 18 feet high.

In small sizes, the concrete filled rubber tire crib member can be rolled into place by hand for assembly. The large tire sizes are robust and strongly reinforced for normal use, enabling moving and placing such crib elements by fork lift or other mechanical means without danger of breaking.

Cribbing of the present invention will also enhance safety. The concrete filled toroid crib members give an audible signal as sufficient load is developed to cause the concrete core of any member to crack. Such a signal is much like that provided by wood cribs as they deform under load. Further, where very high cribbing is required, such that workers may be at risk in installing wedges, the topmost crib member may be a used rubber tire mounted on a rim and inflated at a pressure sufficient to lock the cribbing assembly in place until enough load is exerted to cause the tire to deflate through a relief valve so that the cribbing stays firmly in place as the load increases.

Tests demonstrate that concrete filled tires are extremely resistant to deformation and remain stable and load supporting even after 20 inches of vertical convergence, a significant improvement over prior art concrete crib members. Where maximum support is required, even under yielding conditions, the crenulated hollow core of the stacked rubber tire cribbing can be filled, during construction, with mine rock rubble so that as the cribbing begins to yield, the filled core will help to arrest the convergence of roof and floor. In addition, the high degree of confinement allows a low cost, low density concrete to be used without impairing the normal support performance for cribbing. A range of concrete mixes may be advantageously used to match crib stiffness to roof control requirements.

The ready availability of a wide variety of discarded motor vehicle tires in mining communities the world over makes concrete filled rubber tires the crib envelope material of choice by providing economic incentive for mining companies to dispose of used tires in an ecologically sound manner. In addition, tire stores and the like now pay for disposal of used tires. Manufacturers of cribbing of the invention may thus obtain some of the raw materials at a profit, reducing the cost of manufacture.

While the drawings and tests conducted herein relate to use as mine cribbing, the cribbing members may also be advantageously used to stabilize soil embankments in road units, to construct piers or jetties to reduce ocean erosion, and as offshore underwater artificial reefs to enhance fishery. Each of these uses are enabled by the advantages of the invention, such as compressive strength, resistance to horizontal displacement, ease of handling and low cost. In those uses not requiring high compressive strength, fly ash and flue gas desulfurization sludge and solids may replace at least a portion of the concrete fill, also accomplishing safe disposal of an environmentally troublesome material generated as a by-product by coal fired electric power generating stations and the like.

A further understanding of the invention and further objects, features and advantages thereof will be apparent from a consideration of the following description and the accompanying drawings.

DETAILED DESCRIPTION OF THE DRAWINGS

Figure 1:
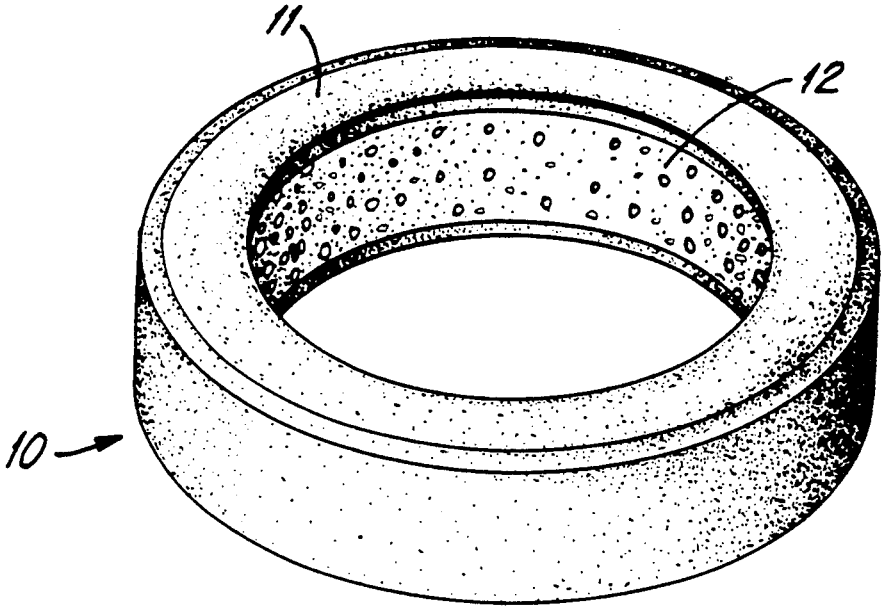
FIG. 1 is an example of a single concrete filled tire crib member.

In FIG. 1, a crib member (10) is shown in which a used steel reinforced vehicle tire (11) has been filled with concrete (12) and allowed to cure. It is ready for transport by hauling or rolling to the site of the crib.

Figure 2:
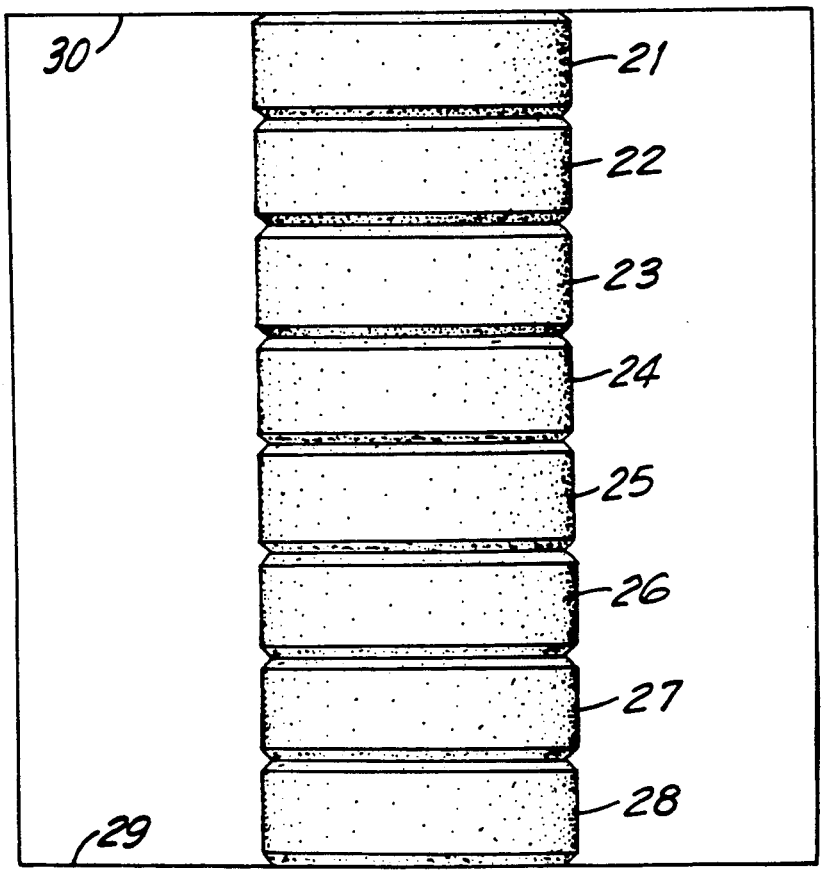
FIG. 2 is an example of crib members of FIG. 1 stacked from floor to ceiling in a mine tunnel environment.

FIG. 2 illustrates the construction of a roof support crib using the concrete filled tires (21, 22, 23, 24, 25, 26, 27 and 28). Because of the resiliency of the rubber, no wood wedging as blocks or load transfer discs are needed. FIG. 2 shows the tires stacked between a mine floor (29) and mine roof or ceiling (30).

Figure 3:
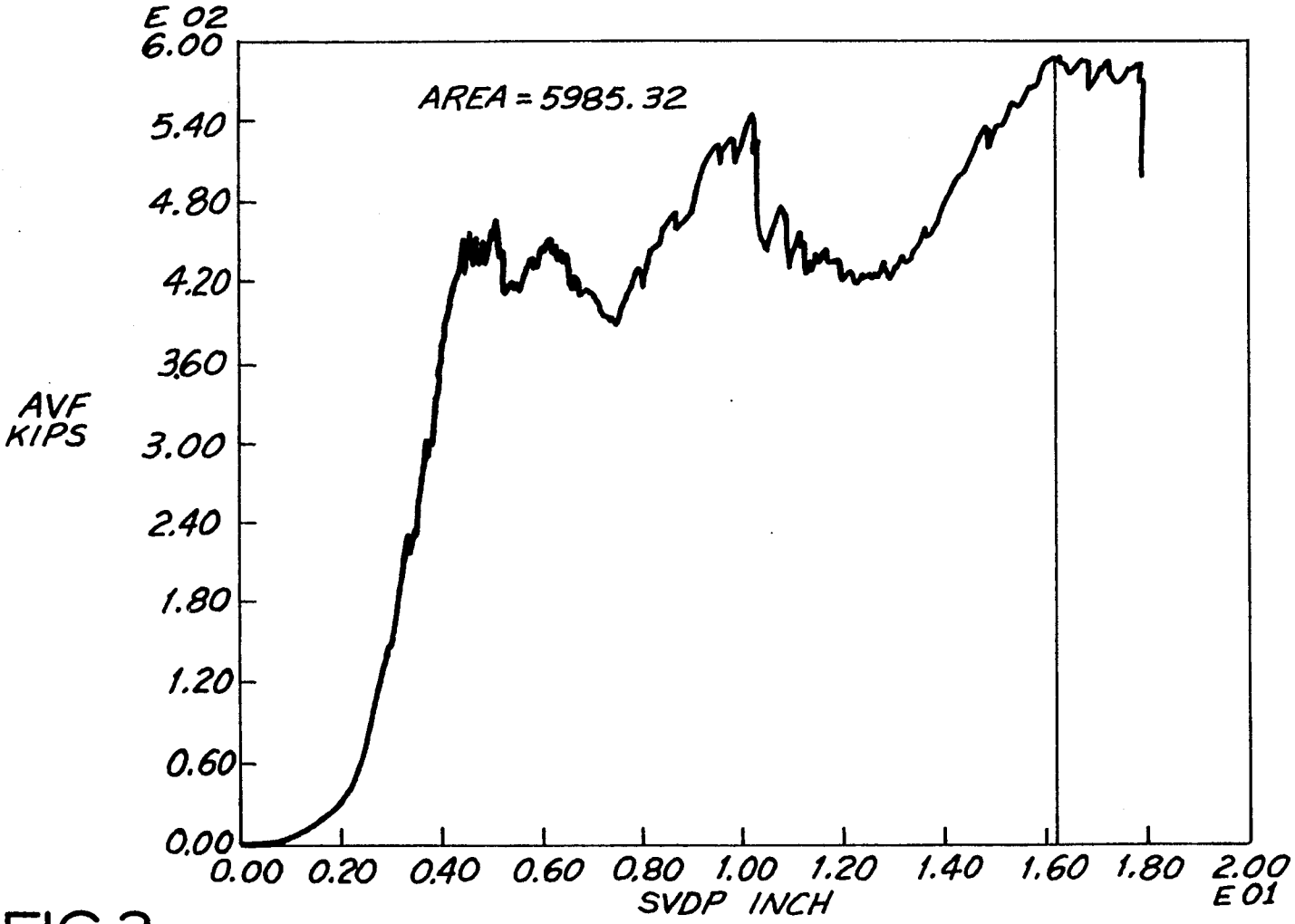
FIG. 3 is a graph of force versus displacement for cribbing of the invention.

FIG. 3 shows the results of testing seven concrete filled tires which were stacked in a crib roof support and subjected to hydraulic force in a simulated mine environment. The vertical axis shows increasing force, while the horizontal axis shows the sum of the vertical displacement. The shape of the curve shows a steady load carrying capacity over a wide range of displacement without failure.

Figure 4:
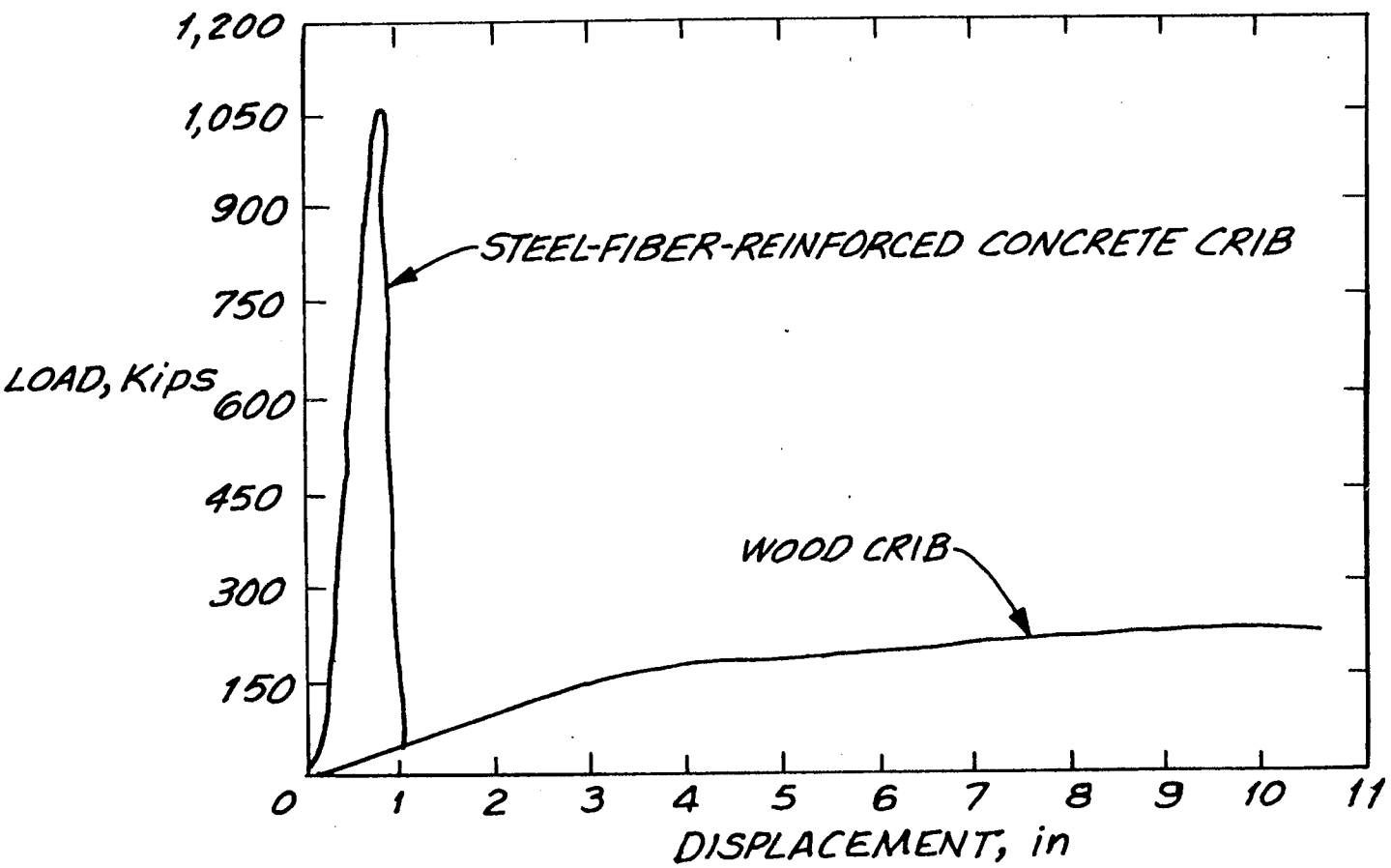
PRIOR ART FIG. 4
FIG. 4 is a graph of force versus displacement for prior art wood and concrete cribbing.

In contrast, FIG. 4 shows a similar test for wood and steel fiber reinforced concrete cribbing, taken from Bureau of Mines IC 9217, 1989, FIG. 20 at page 15. The prior art concrete cribbing shows sudden, catastrophic failure at smaller displacements, while the wood cribbing displays much lower load carrying capacity.

DESCRIPTION OF THE PREFERRED EMBODIMENTS

In the practice of the present invention, any toroidally shaped elastomeric material may be usable, depending on the application. For the most common mine applications, the preferred embodiment utilizes used steel belted radial car or truck tires. While many concrete mixes can be used, in typical mine operations the preferred mix is standard pea gravel concrete. Alternatively, a mix of concretes may be used in different tires of a stack to match the cribbing deformation properties to the geologic conditions of the roof and floor.

Working Examples

Tire Preparation

Used tires were prepared for filling with concrete by cutting a hole in the sidewall between the bead and the tread. The hole was made large enough to allow the concrete mix to be poured into the tire with the aid of a funnel. Alternatively, the concrete may be pumped through a flexible hose into the tire by means of a proper size nozzle. The inner open part of the tire (toroid), where the wheel rim is normally positioned, was closed off with a flexible shield and kept in place by an air inflated membrane (an inner tube). Alternatively, expansion springs or wedges may be used. The tires were placed on a vibrating table so that the concrete mix flowed thixotropically to fill the tire uniformly.

The concrete filled tires were set aside and allowed to cure for at least 14 days so that a nominal 7,000 psi compressive strength was achieved.

Mine Roof Simulator (MRS)

The United States Bureau of Mines (BuMines) has a large hydraulic press at the Bruceton, PA research center designed to simulate roof convergence so that mining machinery and roof support systems can be tested under controlled conditions. The MRS can apply a maximum of 3,000,000 pounds of pressure vertically and a maximum of 1,000,000 pounds horizontally at varying rates. The convergence rates for the tests were at 0.2 inch/minute and 0.5 inch/minute. The MRS was set to deliver 20 inches of vertical displacement.

Tire Crib Assembly

For these tests discarded used tires from 20 inch wheels were used. Only those few that had broken side walls were not used. Seven of these 20 inch tires were stacked vertically for each test. A sheet of plywood was placed at both the bottom and the top of the cribs to protect the steel platens of the MRS from gouging. No other spacers or inserts were used.

The Test

The actual tests were conducted by setting the upper platen of the MRS high enough to accommodate the 7 stacked concrete filled tires and the upper and lower plywood sheets. The tests were programmed and proceeded as designed: at convergence rates of 0.2 and 0.5 inch/minute for a vertical displacement of 20 inches. The test results were tabulated and graphed.

FIG. 3 shows the results of testing a stack of 7 tires fabricated as described. Cribbing of the invention displays a continuous increase in load capacity for vertical displacements up to 18 inches. In contrast, in FIG. 4, prior art wood cribbing shows a smaller and flat load capacity as load increases, and prior art steel-fiber-reinforced concrete cribbing shows a catastrophic failure over much shorter displacement ranges of 1–2 inches. (Bureau of Mines Information Circular 9217, FIG. 20 at page 15.) The data shown in the graphs of FIG. 3 and FIG. 4 were generated on the same machine.

In addition, the cribbing stacks did not displace horizontally, and the individual members failed progressively by radial rupture without losing compressive strength. This illustrates the increased strength, compressibility and safety of cribbing of the invention over prior art wood or concrete cribbing.

The foregoing disclosure and the showings made in the drawings are merely illustrative of the principles of this invention and are not to be interpreted in a limiting sense.

I claim:

1. A method of supporting roofs in an underground mine having a floor and a roof comprising the steps of 1. forming crib members having the compressive strength of solid concrete members while avoiding the catastrophic failure of solid concrete members by
   a. injecting concrete mix into motor vehicle tires;
   b. allowing said concrete to cure to substantially its final strength; and
2. placing sufficient crib members in a stack axially aligned along an axis from floor to roof to form a crib extending from the floor to the roof of the mine.

2. A method according to claim 1 wherein the step of injecting concrete mix into the motor vehicle tires further comprises injecting at least one motor vehicle tire with concrete having a different compressive strength which matches crib stiffness to roof control requirements.

3. A method according to claim 2, wherein the step of injecting concrete into motor vehicle tires further comprises injecting at least one of said tires with a lower strength concrete whereby the crib can yield in a predetermined manner to achieve controlled roof convergence while maintaining support.

4. A method according to claim 1, wherein said motor vehicle tire is reinforced with cotton, synthetic fiber or steel.

5. A method according to claim 1, wherein the top tire in the stack is mounted on a conventional rim, the tire is filled with air, not concrete, and is fitted with a pressure relief valve whereby the top tire will stay in contact with the roof as it deforms, without catastrophic failure, thereby stabilizing the stack.

6. A method according to claim 1 wherein the underground mine is a long wall coal mine.

7. A method of supporting roofs in underground cavities having a floor and a roof by forming a stacked crib having the compressive strength of solid concrete members while avoiding catastrophic failure of solid concrete members said method comprising the steps of 1. placing motor vehicle tires in a stack axially aligned along an axis from floor to roof;
2. injecting concrete mix into an interior of said stack; and
3. allowing said concrete to cure to substantially its final strength.

* * * * *